United States Patent [19]

Dunn

[11] Patent Number: 4,893,667

[45] Date of Patent: Jan. 16, 1990

[54] PERFORATED WINDOW COVERINGS

[76] Inventor: William F. Dunn, 6050 Melody La., Suite 105, Dallas, Tex. 75231

[21] Appl. No.: 104,212

[22] Filed: Oct. 2, 1987

[51] Int. Cl.[4] ..... E06B 9/00

[52] U.S. Cl. ..... 160/236; 160/166.1; 160/900

[58] Field of Search ..... 160/166 R, 236

[56] References Cited

U.S. PATENT DOCUMENTS

| | | | |
|---|---|---|---|
| 853,862 | 5/1907 | Buck . | |
| 936,183 | 5/1909 | Stein . | |
| 1,678,748 | 7/1928 | Smith | 160/236 X |
| 1,733,770 | 10/1929 | Andrake | 160/236 X |
| 1,791,162 | 2/1931 | Ellis | 160/236 X |
| 2,142,629 | 1/1939 | Clark, Jr. | 160/236 X |
| 2,319,225 | 5/1943 | Grebe et al. | 154/46 |
| 2,366,224 | 1/1945 | Warp | 98/121 |
| 2,441,819 | 5/1948 | Jensen | 154/46 |
| 2,492,909 | 12/1949 | Warp | 98/121 |
| 2,592,888 | 4/1952 | Greegor | 160/236 |
| 2,855,039 | 10/1958 | Gross | 160/236 |
| 3,071,825 | 1/1963 | Ferris | 160/196.1 X |
| 4,723,588 | 2/1988 | Ruppel | 160/236 |

FOREIGN PATENT DOCUMENTS

| | | | |
|---|---|---|---|
| 837171 | 3/1952 | Fed. Rep. of Germany | 160/236 |

*Primary Examiner*—Blair M. Johnson

*Attorney, Agent, or Firm*—Hubbard, Thurman, Turner, Tucker and Harris

[57] ABSTRACT

Light admitting window coverings are provided with apertures which are formed in a covering such as a vertical blind louver. The louver is formed of opposed panel portions with a transparent film or sheet sandwiched therebetween to provide for sufficient light transmission and visibility through the louvers in the closed position but without permitting convective heat transmission through the window covering. The blind louvers may be formed with an insulating air space between the opposed louver panel portions and the transparent film or sheet. The blind louvers or single panel apertured blind louvers and the like may be formed with apertures at an acute angle extending downward towards the airspace formed between a windowpane and the window covering to minimize convective air flow from the room interior into the space between the window and the blind louver when the room temperature exceeds the outside ambient temperature and to prevent heat buildup in the space between the window coverings and the windowpane when the temperature in the room interior air space is less than the temperature in the airspace between the window covering and the windowpane.

8 Claims, 3 Drawing Sheets

PERFORATED WINDOW COVERINGS

BACKGROUND OF THE INVENTION

1. Field of the Invention

The present invention pertains to perforated, light admitting window blinds and similar coverings which provide for light transmission and sufficient transparency while reducing heat loads or losses with respect to the window covered by the blinds.

2. Background

In the art of window coverings, including vertical and horizontal blinds or louvers, it is particularly desirable to provide coverings which are sufficiently transparent to permit virtually unrestricted visibility through the coverings from inside a building while at the same time having a sufficient degree of opacity to provide privacy. Such coverings should also be capable of minimizing thermal loads imposed on the interior of the building or to prevent heat losses from the building.

Although certain types of perforated window coverings have been developed in the prior art these coverings do not minimize heat loss from the building interior or, conversly, minimize thermal loading on the building interior from the exterior environment through the window covered by such types of blinds or similar coverings. Conventional window coverings such as horizontal venetian blinds may, in fact, increase the flow of air over the surface of the window across which the blinds are disposed to actually increase thermal losses with respect to the building interior.

Accordingly, with the increased costs associated with heating and cooling building interiors there has been an acute need for improved window coverings which are capable of permitting at least daytime viewing of the outside while reflecting a substantial amount of heat and glare, maintaining a level of opacity from outside for privacy and still further providing minimal thermal losses with respect to the building interior. In this regard, the present invention provides an improved window covering having perforations which provide sufficient light transmission so as to permit substantially unrestricted visual perception through the window while minimizing thermal losses through the window.

SUMMARY OF THE INVENTION

The present invention provides an improved window covering comprising a perforated blind louver or panel which is provided with perforations of a size and density sufficient to permit suitable light transmission and visibility through the window covering in the closed position while minimizing thermal losses through the window across which the covering is disposed.

In accordance with one aspect of the present invention there is provided a perforated window covering such as an arrangement of a plurality of horizontal or vertically extending window blind louvers wherein, in the closed position of the louvers, a high degree of visibility may be obtained looking from one side of the window covering through to the other side and wherein the perforations are covered with a transparent panel to prevent convective flow of air through the perforations in the blind louvers or other covering panel in the closed position thereof.

In accordance with another aspect of the present invention there is provided a light transmitting window covering providing a high degree of visibility wherein a plurality of blind louvers are provided which are of multi layer construction characterized by a louver panel having aligned perforations in two adjacent sheets between which is disposed a transparent sheet or panel of clear material such as vinyl or acrylic type plastic. The blind louver is advantageously made in one integral part which comprises opposed panel sheets which may be folded one over the other and secured to provide a sandwich construction wherein the transparent sheet or panel is trapped between the opposed layers or sheets of the integral louver panel The opaque, perforated louver is preferably made in one piece and both sheets of the panel are perforated in one operation so as to assure alignment of the perforations when the panel layers or sheets are folded one over the other and locked in position with the transparent sheet disposed therebetween. The particular configuration of the perforated, light transmitting panel provides for economical high volume production of vertical as well as horizontal type window blind louvers which have superior light transmissability and reduced thermal losses therethrough.

In accordance with another aspect of the present invention there is provided a window covering having a series of perforations therein to provide suitable light transmission and visibility through the covering and wherein the perforations are disposed at an angle with respect to the plane of the covering material itself and oriented with respect to an exterior window pane so as to minimize heat loss from the building interior through the window to the exterior environment and to minimize heat buildup between the windowpane and the window covering itself. The perforations may be arranged as generally horizontally extending elongated slits having a predetermined minimum height so as to provide suitable visual perception through the window coverings. Moreover, the cross-sectional geometry of the perforations may take various forms in accordance with aesthetic requirements.

Those skilled in the art will recognize the above-described features and advantages of the present invention together with other superior aspects thereof on reading the detailed description which follows in conjunction with the drawing.

DESCRIPTION OF THE PREFERRED EMBODIMENTS

Figure 1:
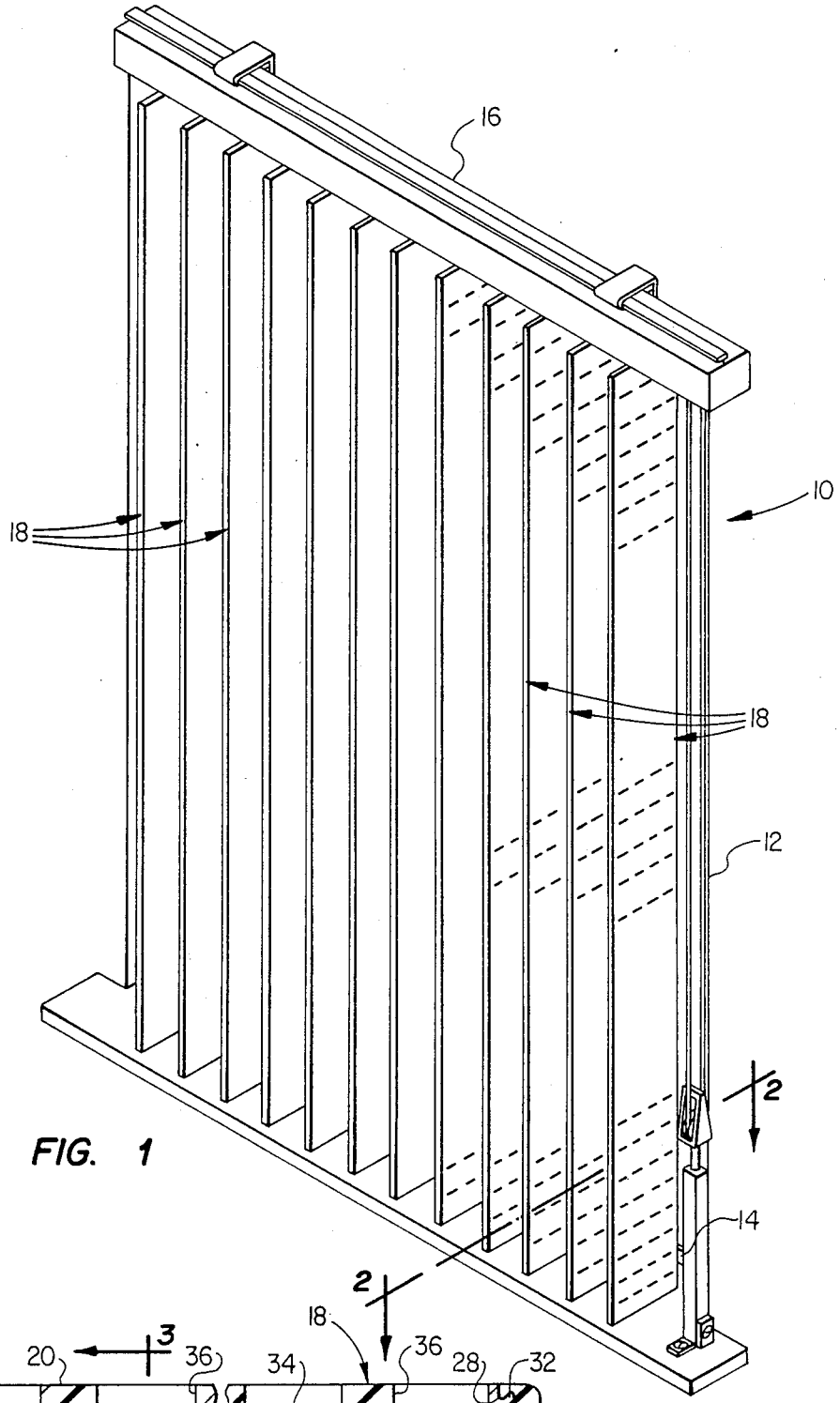
FIG. 1 is a perspective view of a vertical free-hanging rotating window blind assembly including blind louvers in accordance with the present invention.

In the description which follows like parts are marked throughout the specification and drawing with the same reference numerals, respectively. The drawing figures are not necessarily to scale and certain features of the invention may be shown exaggerated in scale or in somewhat schematic form in the interest of clarity.

Referring to FIG. 1, there is illustrated a verticl type window blind assembly, generally designated by the numeral 10. The blind assembly 10 is illustrated as being disposed across a windowpane 12 fitted in a frame 14. The blind assembly 10 is characterized by a conventional support track assembly 16 including suitable mechanism, not shown, for supporting and rotating a plurality of parallel side by side blind louvers 18 and also for traversing the louvers 18, if desired, from one end of the track 16 to the other. The track assembly 16 does not form a part of the invention, per se and is not believed to require further description in order to enable one to practice the invention. In an extended position of the louvers 18 across the window 12, the louvers may be rotated to be substantially coplanar to form a covering across the area of the window 12 to reduce light transmission and to also minimize the exchange of heat between the interior of the room occupied by the blind assembly 10 and the exterior environment. It has become particularly desirable to provide widow closures such as the blind assembly 10, which, in the closed position of the louvers 18 provide for substantially unrestricted visibility of the outside environment from within the building while, at the same time, minimizing the transmission of heat from the building interior through the window 12 to the exterior environment or vice versa. In this regard it has been previously suggested to provide the louvers 18, for example, or similar louvers with perforations arranged in rows and columns or in other predetermined patterns so that sufficient light transmission is possible whereby a relatively unrestricted view of the exterior environment may be obtained at least during daylight. However, a major disadvantage of prior art perforated louvers pertains to the fact that the perforations permit transmission of heated air through the louvers in the closed position, thereby substantially reducing a major advantage of the window covering and contributing to increased heating and cooling loads on the building interior.

Figure 2:
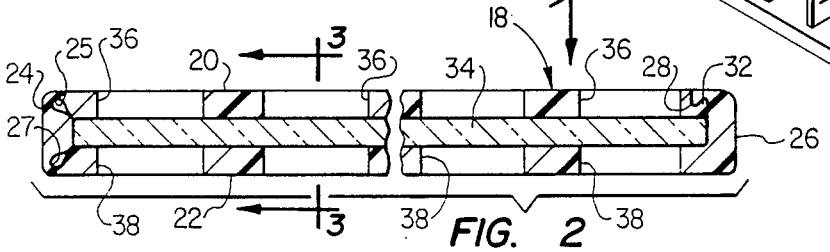
FIG. 2 is detail section view taken generally along the line 2-2 of FIG. 1.
Figure 3:
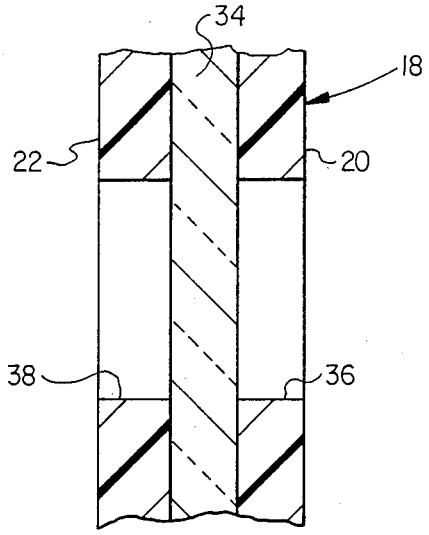
FIG. 3 is a detail section view taken generally along the line 3-3 of FIG. 2.
Figure 4:
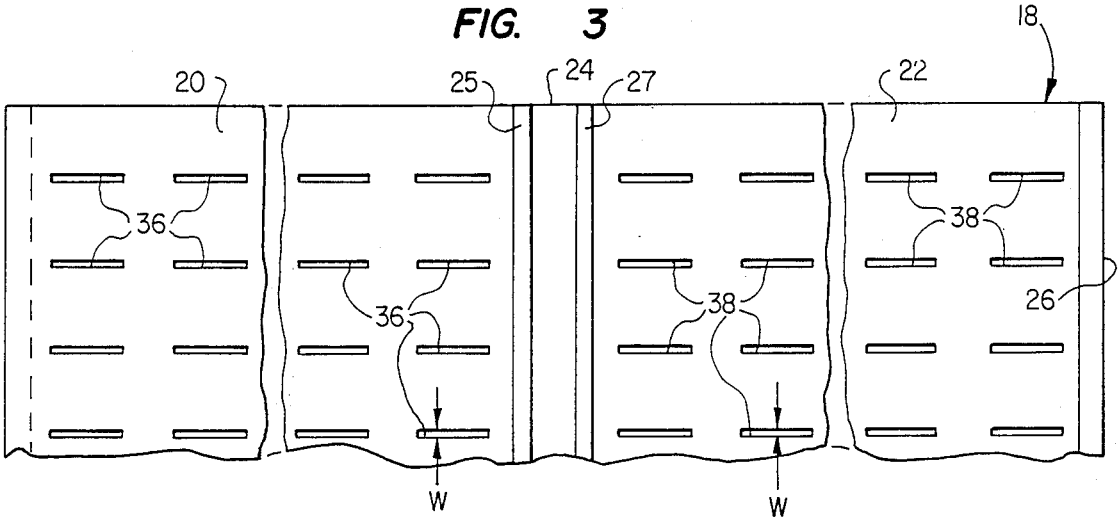
FIG. 4 is a partial plan view of one of the blind louvers of the embodiment of FIG. 1 in an open position with the transparent panel or sheet removed.

Referring now to FIGS. 2 through 4, one of the louvers 18 is shown in detail sufficient to illustrate its unique characteristics. As illustrated in FIGS. 2 through 4, each of the louvers 18 is preferably characterized by opposed generally planar panel portions or sheets 20 and 22 which are joined together along an integral, hinge portion 24. The panel portion 22 includes an integral longitudinal edge part opposite the hinge portion 24 and designated by the numeral 26. The longitudinal edge 26 includes a reentrant projection 28 forming a notch for receiving a cooperating projection 32 formed on the panel portion 20. The panel portions 20 and 22 are formed by folding an elongated flat louver blank along the hinge portion 24 which is suitably formed with longitudinal spaced apart parallel grooves or indentations 25 and 27 to permit folding the panel portions 20 and 22 relative to each other to form a generally rectangular cross-sectional configuration of the louver 18. As illustrated in FIGS. 2 and 3, in the assembled condition of the louver 18 a generally flat transparent sheet or panel 34 is sandwiched between the panel portions 20 and 22.

The panel portions 20 and 22 are each provided with a series of aligned perforations 36 and 38, respectively, which are arranged in rows and columns, as indicated in FIG. 4 so that when the panel portion 20 is folded over along the grooves 25 and 27 it is aligned with the panel portion 22 and the perforations 36 are aligned with the perforations 38. Accordingly, depending on the length, width and spacing of the perforations 36 and 38, a relatively high degree of visibility may be obtained through the louvers 18 in their closed positions and, thanks to the provision of the transparent sheet 34, convection heat losses through the louvers 18 are negated.

The perforations 36 and 38 are preferably somewhat rectangular shaped openings that have a variable thickness or width W, FIG. 4, of typically about 0.010 inches up to about 0.040 inches and a length that can be varied to suit. A perforation spacing pattern providing for anywhere from about 6% and above perforation area as a percent of the total area of the louver 18 is preferred for suitable visibility through the louver. Moreover, the material of the transparent or panel sheet 34 may be modified to control the amount of opacity or light transmissivity such as by applying reflecting coatings or films to the surface of the panel sheet 34 or providing the entire thickness of the panel sheet 34 of a controlled material as regards light transmission and refraction. Optionally, the perforations 36 and 38 can extend through the panel portions 20 and 22 in an acute angular orientation in the manner of FIGS. 7–11 as will be described.

Figure 5:
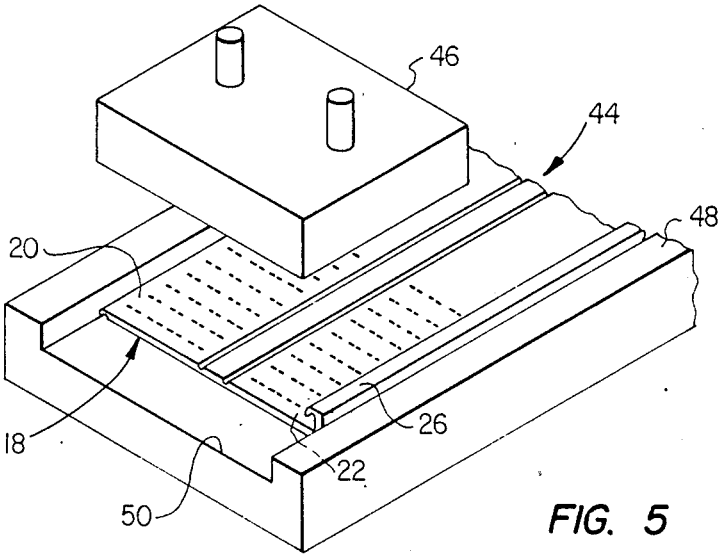
FIG. 5 is a perspective view in somewhat schematic form illustrating one method of manufacturing the blind louver of the invention.

The louvers 18 may be formed of extruded material such as rigid vinyl (PVC) or extruded metals such as aluminum. The configuration of the louver 18, comprising the opposed panel portions or sheets 20 and 22, permits high volume production of the panel portions to form the perforations 36 and 38, which perforations may be easily aligned with each other upon folding the panel portions 20 and 22 into the assembled and locked position as illustrated in FIG. 2. For example, referring briefly to FIG. 5, there is illustrated in somewhat schematic form a die set for forming the perforations 36 and 38. The die set illustrated is generally designated by the numeral 44 and comprises a punch plate assembly 46 and a die plate assembly 48 having a die member forming a channel 50 in which a louver member 18 is disposed in the open position with the panel portions 20 and 22 substantially coplanar with each other. The channel 50 is of a width corresponding substantially to the width of an unfolded louver 18 when the panel portions or sheets 20 and 22 are coplanar. By forming the perforations 20 and 22 simultaneously in a controlled setting as determined by the die set 44 it is assured that when the panel portions 20 and 22 are folded relative to each other into the position illustrated in FIG. 2 that the perforations 36 and 38 will be aligned with each other sufficiently to minimize any distortion of light transmission through the louvers 18. Alternatively, the panel portions can be punched when in their folded envelope relation so as to assure greater accuracy of registration between the opposed perforations when the panels are in their assembled relation of FIG. 2.

Figure 6:
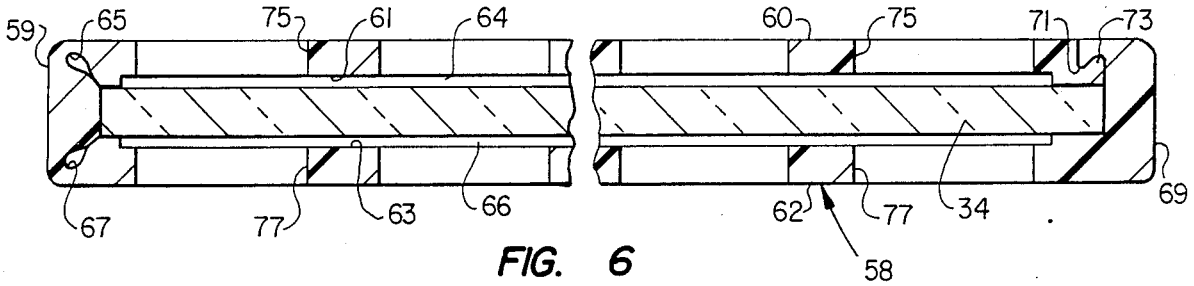
FIG. 6 is a detail section view, of an alternate embodiment of the present invention.

Referring now to FIG. 6, an alternate embodiment of a window blind louver in accordance with the present inventin as illustrated and generally designated by the numeral 58. The louver 58 is similar to the louver 18 with the exception that the louver 58 includes opposed panel portions 60 and 62 are each formed with elongated recesses 61 and 63, respectively which provide spaces 64 and 66 on each side of the transparent panel member 34 along a major portion of the louver 58 to form additional heat insulating or thermal barriers to the transmission of heat through the louvers when in the closed position of a blind assembly such as the blind assembly 10 illustrated in FIG. 1. The construction of the louver 58 is otherwise substantially identical to the louver 18 but the spaces 64 and 66 provided between the louver panel portions and the transparent panel or sheet 34 provide a reduction in the conductive heat transfer of a blind assembly utilizing the louvers 58. The louver 58 includes an integral hinge portion 59 formed in part by grooves 65 and 67. The longitudinal edge 69 of panel portion 62 includes a reentrant projection 71 adapted to be in locking engagement with a cooperating projection 73 formed on the panel portion 60. The panel portions 60 and 62 are formed to have aligned perforations 75 and 77 similar to the perforations of the louver 18.

Figure 7:
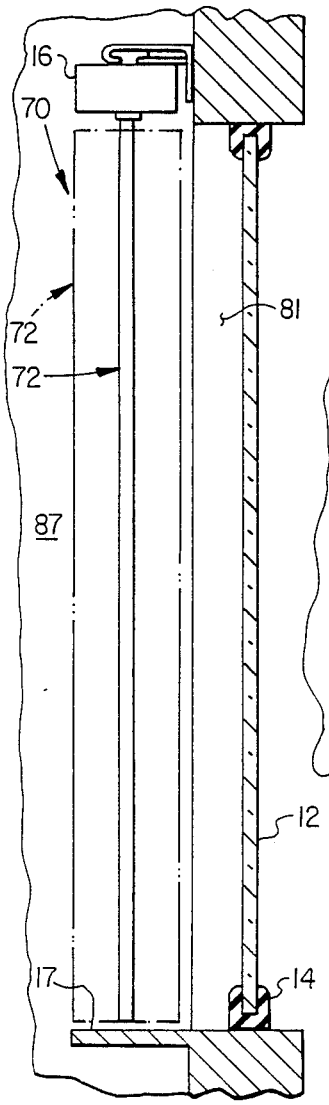
FIG. 7 is an elevation, in section, of a perforated window covering in accordance with a second alternate embodiment of the invention.
Figure 8:
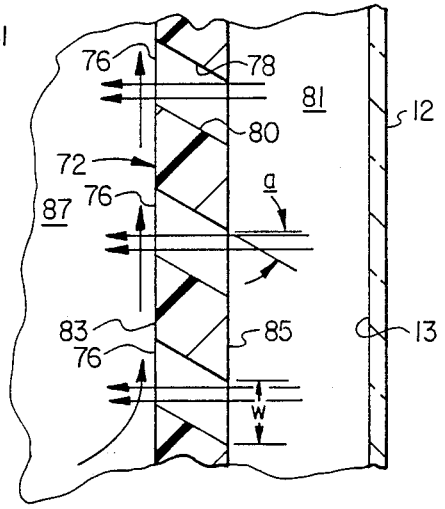
FIG. 8 is a detail view taken from the same line as the view of FIG. 6 but on a larger scale.

Referring now to FIGS. 7 and 8, there is illustrated an alternate embodiment of a window blind assembly, generally designated by the numeral 70 and characterized by a support structure or track assembly 16 and a plurality of vertically hanging blind louvers 72, one shown in the closed position thereof. The louvers 72 preferably extend to a point directly adjacent a sill 17 of the window frame 14 so as to minimize the opportunity for air flow vertically in the space between the louvers 72 and the windowpane 12 when the louvers are in the closed and coplaner position illustrated by the solid lines in FIG. 7.

The louvers 72 include a substantial number of spaced apart perforations 76, as shown in FIG. 8, which are of approximately the same width or height and the same length as the perforations provided in the blind louvers 18 and 58. However, the perforations 76 are delimited by upper and lower generally parallel side walls 78 ad 80 which are formed at an angle with respect to the opposed planar surfaces 83 and 85 of the louvers 72, as shown by way of example in FIG. 8. In a preferrd arrangement of the louvers 72, the perforation side walls 78 and 80 slope downwardly toward the windowpane 12 so that if the temperature in the space 81 between the louvers 72 and the inside surface 13 of the windowpane 12 exceeds the temperature in the space 87 comprising the interior room shielded by the blind assembly 70 heated air in the space 81 will flow relatively freely through the perforations 76 and into the space 87 thanks to the angle of orientation of the perforation sidewalls 76 and 78. This arrangement will tend to relieve the buildup of heat between the blind assembly 70 and the windowpane 12 without permitting a substantial flow of heated air into the room interior space 87. On the other hand the orientation or inclination of the perforations 76 in the direction indicated will, in times when the temperature in the space 87 exceeds that in the space 81 permit convective flow of air vertically along the surface 83 without substantial flow through the perforations into the space 81 to thereby minimize heat loss from the space 87 through the windowpane.

The angle a of the perforations 76, FIG. 8, with respect to a horizontal plane typically may be between about 17–21 degrees or may be more or less as desired. The vertical width W of the perforations is preferably such that horizontal light rays may be transmitted through the perforations so that substantially uninterrupted visibility through the louvers 72 is obtainable when looking through the louvers 72 and the window pane 12 from the space 87.

Figure 10:
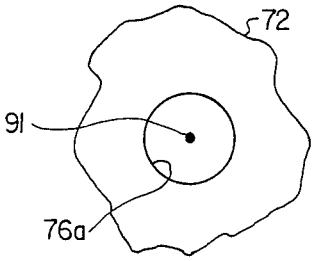
FIGS. 9 through 11 illustrate one alternate configuration of perforations for use with the embodiments of the present invention.
Figure 11:
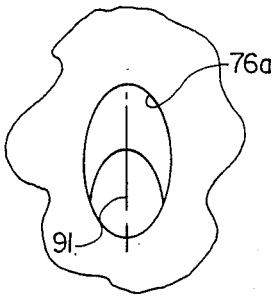
Figure 9:
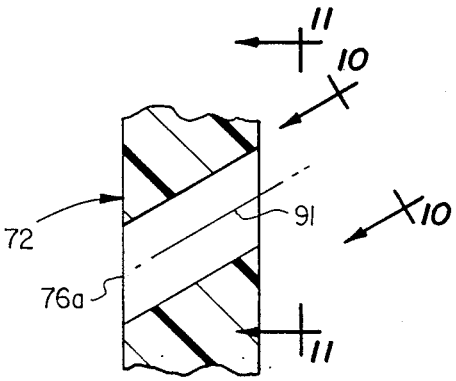

The configuration of the perforations 76 may be varied somewhat whereby the shape of the perforation determines the light penetration versus the angle relationship. For example, as illustrated in FIGS. 9 through 11, a perforation **76*a* having a circular cross-sectional shape when viewed from a plane normal to the axis 91 of the perforation itself, as shown in FIG. 10, will have a somewhat elliptical shape, FIG. 11, when viewed from a plane parallel to the plane of the louver 72. Moreover, a square cross section perforation will be viewed as a rectangle when viewed from a line of sight perpendicular to the plane of the louver 72. Still further, a triangular perforation will be viewed as a triangle of smaller area from a line of sight perpendicular to the plane of the louver 72. Accordingly, by providing perforations having a central axis formed at an angle with respect to the plane of the louver 72 the percentage of indirect light versus direct light admitted through the blind assembly 70 may be controlled. The angle formed between the central axis of the perforations and a line normal to the widowpane 12 also minimizes the convective flow of air between the spaces 87 and 81 when the temperature in the space 87 is greater than the temperature in the space 81, and relieves the space 81 of intense heat buildup which can unduly stress the material of the windowpane 12** in southern climes in particular.

Although preferred embodiments of perforated, light admitting window coverings have been disclosed herein, those skilled in the art will recognize that the inventive features may be utilized in conjunction with window coverings other than the vertical blind louvers illustrated by way of example. For example, horizontal blind louvers may also be formed in accordance with the invention or the window covering may comprise a generally planar member such as a window shade.

Those skilled in the art will recognize that other modifications and substitutions may be made to the specific structure shown and described without departing from the scope and spirit of the invention as recited in the appended claims.

What I claim is:

1. A light transmitting window covering for placement generally adjacent to a window pane on the building interior space side thereof to provide for admission of a predetermined amount of light to said interior space and substantially unrestricted visibility through said covering from said interior space, said covering including:

a panel formed of substantially opaque material, said panel including a substantial number of small spaced apart apertures formed therein to permit direct, generally horizontal rays of light to be transmitted through said panel, and transparent means covering said apertures to form a barrier to air flow through said panel;

said panel including opposed panel portions disposed on opposite sides of said transparent means, each of said panel portions including a set of apertures corresponding to the set of apertures of the other panel portions, and said panel portions being aligned with each other such that said apertures permit direct transmission of light through said window covering and the registration portions of said transparent means intevening between said panel portions, respectively;

said transparent means including a transparent sheet and said panel portions being spaced from said sheet over a major portion of said sheet to form an insulating air space between said panel portions and said sheet, respectively;

and means for mounting said panel inside a building adjacent to a window pane.

2. The window covering set forth in claim 1 wherein:

said panel portions are joined together at a common hinge portion, and said panel is formed by folding said panel portions to be disposed directly adjacent each other with said transparent sheet disposed therebetween.

3. The window covering set forth in claim 2 wherein:

said panel portions include cooperating means for securing one panel portion to the other in the folded position of said panel portions, respectively.

4. The window covering set forth in claim 1 wherein:

said panel comprises a blind louver.

5. The window covering as claimed in claim 1, wherein:

said panel includes a generally rectangular single sheet of substantially opaque material, said sheet including means forming an integral hinge dividing said sheet into two panel portions, each of said panel portions having an edge parallel to said hinge;

said transparent means includes a sheet of substantially transparent material having a shape and size to fit between said panel portions;

and said panel includes means for fastening said panel portions together about said transparent sheet.

6. The window covering as claimed in claim 5, wherein said fastening means includes complementary interlocking portions formed on said edges of said panel portions.

7. A light transmitting window covering, which comprises:

a generally rectangular panel including a single sheet of substantially opaque material, said sheet including means forming an integral hinge dividing said sheet into two panel portions, said sheet being foldable along said hinge such that said panel portions overlie each other and define a plane, said panel portions each having formed therein plurality of apertures to register with each other when said sheet is folded to permit light rays substantially perpendicular to the plane of said panel to pass through said apertures;

a sheet of transparent material positioned between said folded panel portions, said panel portions being spaced apart from said sheet over a major portion of said sheet to form an insulating air space between said sheet and said panel portions;

means for fastening said panel portions about said transparent sheet;

and means for mounting said panel in building with said panel adjacent to a window pane.

8. The light transmitting window covering as claimed in claim 7, wherein said means for fastening said panel portions about said transparent sheet includes interlocking portions formed on the edges of said opaque sheet.

* * * * *